United States Patent [19]

Okumura et al.

[11] Patent Number: 4,998,716

[45] Date of Patent: Mar. 12, 1991

[54] SORTER WITH JAM-PREVENTING MEMBERS

[75] Inventors: Keiji Okumura, Amagasaki; Kenichi Matsunobu, Nara, both of Japan

[73] Assignee: Mita Industrial Co., Ltd., Osaka, Japan

[21] Appl. No.: 375,754

[22] Filed: Jul. 5, 1989

[30] Foreign Application Priority Data

Jul. 11, 1988 [JP] Japan ..... 63-172388

[51] Int. Cl.[5] ..... B65H 39/10

[52] U.S. Cl. ..... 271/297; 271/305

[58] Field of Search ..... 271/161, 184, 188, 287, 271/292, 296, 297, 300, 303, 305

[56] References Cited

U.S. PATENT DOCUMENTS

| | | | |
|---|---|---|---|
| 3,937,459 | 2/1976 | Lawrence | 271/297 |
| 4,026,540 | 5/1977 | Lawrence | 271/287 |
| 4,116,429 | 9/1978 | Van Buskirk et al. | 271/287 |
| 4,228,996 | 10/1980 | Wilcox, Jr. | 271/305 |
| 4,317,203 | 2/1982 | Botte et al. | 271/296 |
| 4,501,419 | 2/1985 | Takahashi et al. | |
| 4,555,106 | 11/1985 | Ruenzi | 271/297 |
| 4,741,524 | 5/1988 | Bromage | 271/305 |
| 4,819,931 | 4/1989 | Goto et al. | 271/305 |

FOREIGN PATENT DOCUMENTS

| | | | |
|---|---|---|---|
| 112269 | 7/1982 | Japan | 271/287 |
| 2059397 | 4/1981 | United Kingdom | 271/297 |
| 1596590 | 8/1981 | United Kingdom | |

*Primary Examiner*—H. Grant Skaggs
*Assistant Examiner*—Steve Reiss
*Attorney, Agent, or Firm*—Jordan and Hamburg

[57] ABSTRACT

A sorter includes a plurality of sheet receiving units, a conveyor for converying a sheet to one of a plurality of sheet receiving units which are able to come into contact with one surface of the sheet, a guide facing the other surface of the sheet for guiding the sheet to one sheet receiving unit, and a restriction device provided at substantially the same level as the conveyor for keeping the sheet from moving to the conveying means.

10 Claims, 8 Drawing Sheets

(a)

(b)

SORTER WITH JAM-PREVENTING MEMBERS

BACKGROUND OF THE INVENTION AND RELATED ART STATEMENT

This invention relates to a sorter for arranging sheets of paper discharged from the main body of a copying machine or the like into a predetermined number of groups.

Sorters are generally classified into a movable bin type and a fixed bin type. The movable bin type of sorter carries movable bins which are moved according to the number of paper sheets to be sorted. The fixed bin type of sorter carries bins which are always held in respective fixed positions. Most sorters of the fixed bin type include a conveying belt for conveying paper sheets discharged from the main body in a vertical direction, and guide means for introducing sheets from the conveying belt to a selected bin.

FIGS. 9 and 10 show a conventional sorter. Indicated at 101 are conveying belts which are driven in a downward direction. Indicated at 102 are conveying rollers. The conveying roller 102 is made in contact with the conveying belt 101 and rotated in such a direction as to convey a paper sheet in the downward direction. Also, one conveying roller 102 corresponds to one of vertically arranged a plurality of bins 104. Under the conveying roller 102 is provided a horizontal shaft 106 which carries a plurality of claw members 105. It should be noted that in FIG. 9, the horizontal shaft 106 is disposed in a direction perpendicular to the drawing plane. The claw members 105 are horizontally spaced from one another so as not to come into contact with the conveying rollers 102. Also, the claw members 105 are pivotable about the shaft 106. When sorting, only claw members 105 which faces a selected bin 104 are pivoted in a clockwise direction in FIG. 9 so that they are projected in a conveying path defined by the conveying belt 101.

Consequently, a paper sheet conveyed in the downward direction by the conveying belt 101 is introduced to the selected bin 104 by the pivoted claw members 105.

Also, there have been disclosed other ways to separate a paper sheet from a conveying belt, specifically, a way in which a paper sheet is separated from a conveying belt by a claw capable of coming into direct contact with the conveying belt, and another way in which a paper sheet is separated from a conveying belt by a claw attached to the same shaft as a conveying roller 102.

In the sorter of FIGS. 9 and 10, a paper sheet is inserted between the conveying roller 102 and the claw member 105, and then pressuringly transferred to the selected bin 104 by the rotation of the conveying roller 102. In this condition, the sheet is kept from rising in portions corresponding to the conveying rollers 102, but is liable to rise in other portions. Consequently, the sheet comes into a form of wave as shown with a solid line 107 in FIG. 10. Accordingly, it could be seen that a rise portion of the wavy sheet is liable to come into contact with a lower portion of a support member 103 to cause jam.

SUMMARY OF THE INVENTION

It is an object of the present invention to provide a sorter which makes it possible to prevent a paper sheet from waving and being jammed.

Accordingly, a sorter of the present invention comprises a plurality of sheet receiving units, conveying means for conveying a sheet to one of the plurality of sheet receiving units with coming into contact with one surface of the sheet, guide means facing the other surface of the sheet for guiding the sheet to the one sheet receiving unit, and restriction means provided at substantially the same level as the conveying means for keeping the sheet from moving to the conveying means.

The restriction means prevents a sheet from waving. Consequently, jam is eliminated and smooth discharging is assured.

BRIEF DESCRIPTION OF THE DRAWINGS

FIG. 8 (*b*) is a sectional view taken along the line 8B—8B in FIG. 7;

DETAILED DESCRIPTION OF PREFERRED EMBODIMENTS

Figure 6:
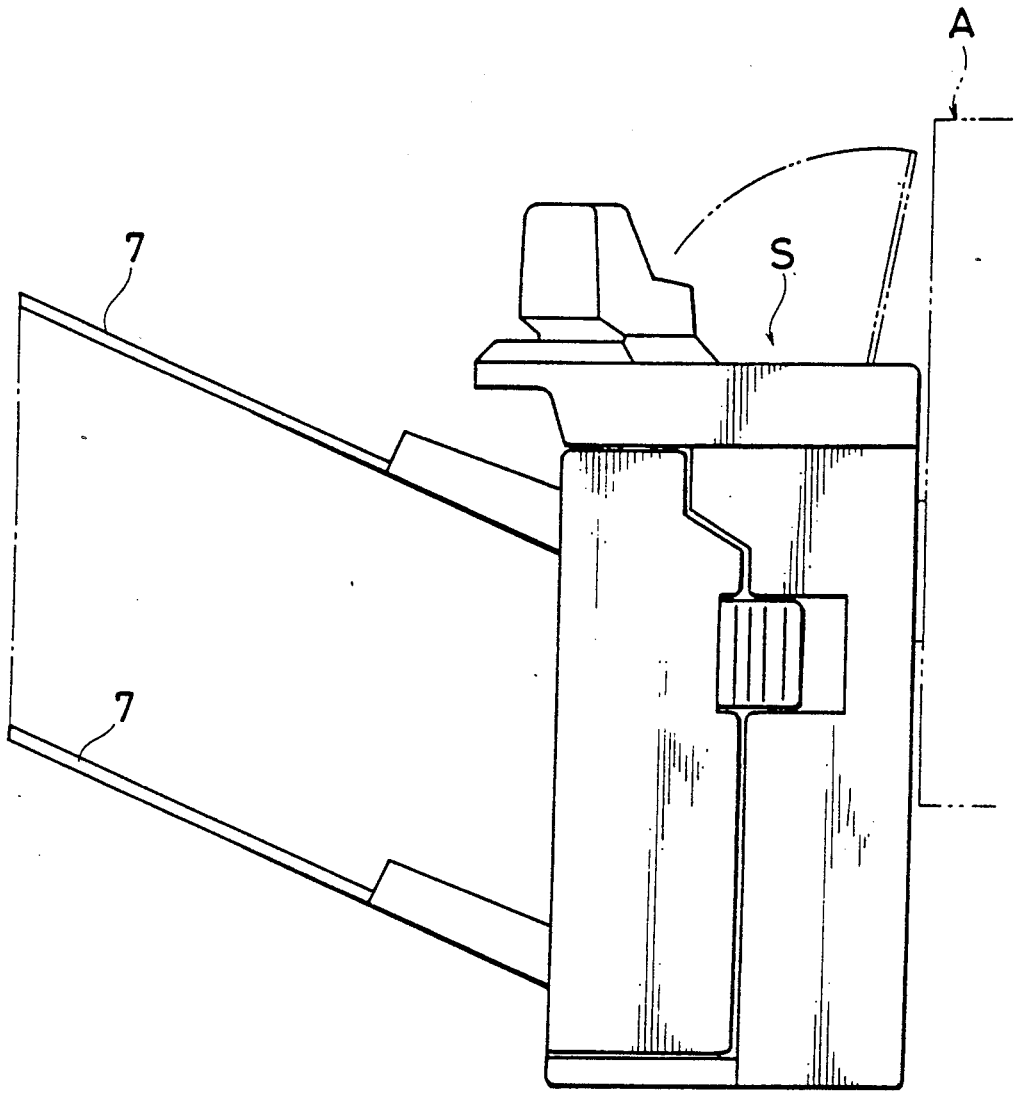
FIG. 6 is a side elevational view of the sorter.

A first embodiment of the present invention will be described with reference to FIGS. 1 to 6. A sorter S of the first embodiment is placed on a discharge side of a main body A of a copying machine or the like as shown in FIG. 6 to sort sheets of paper discharged from the main body A.

Figure 1:
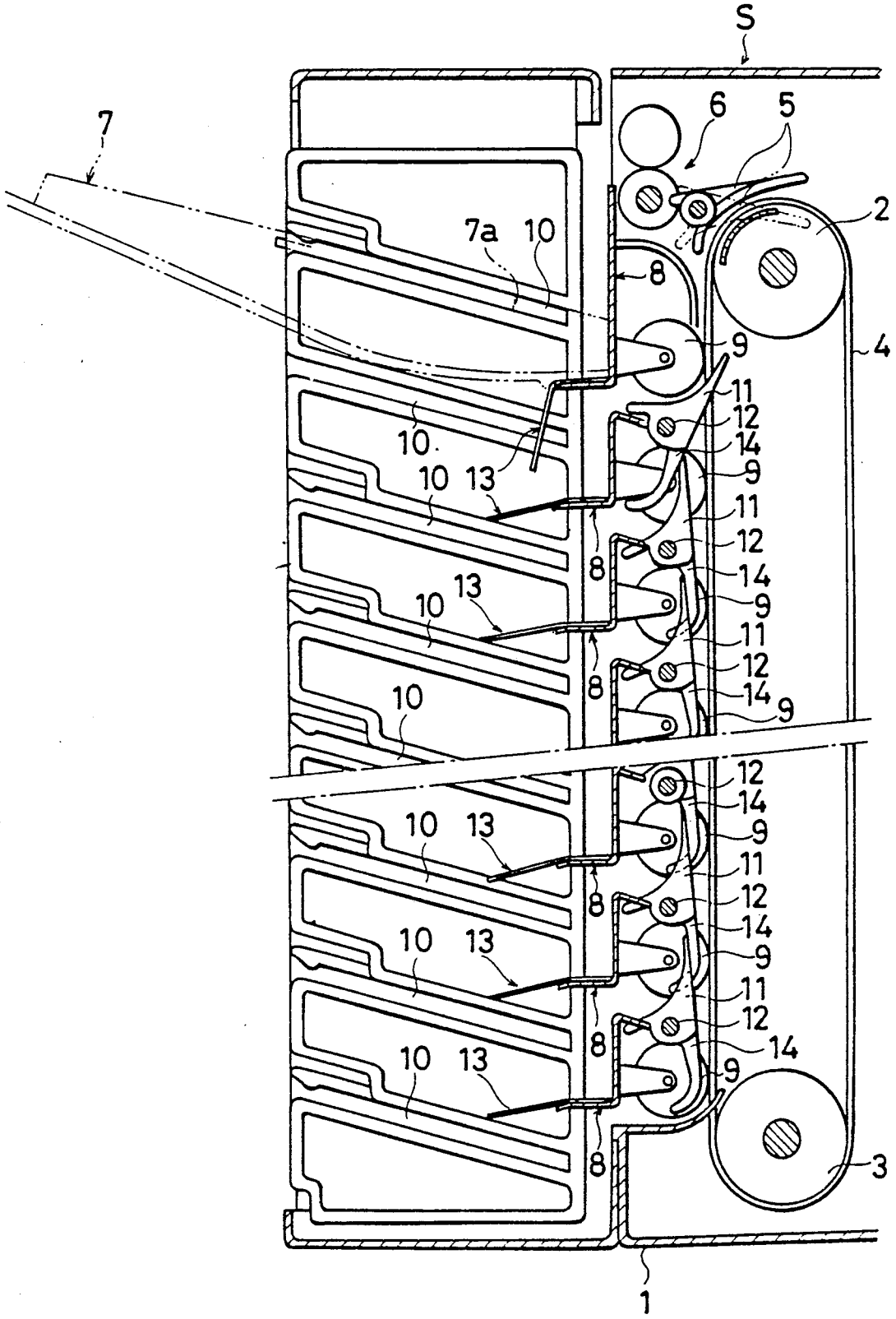
FIG. 1 is a sectional elevational view of a sorter according to a first embodiment of the present invention.
Figure 3:
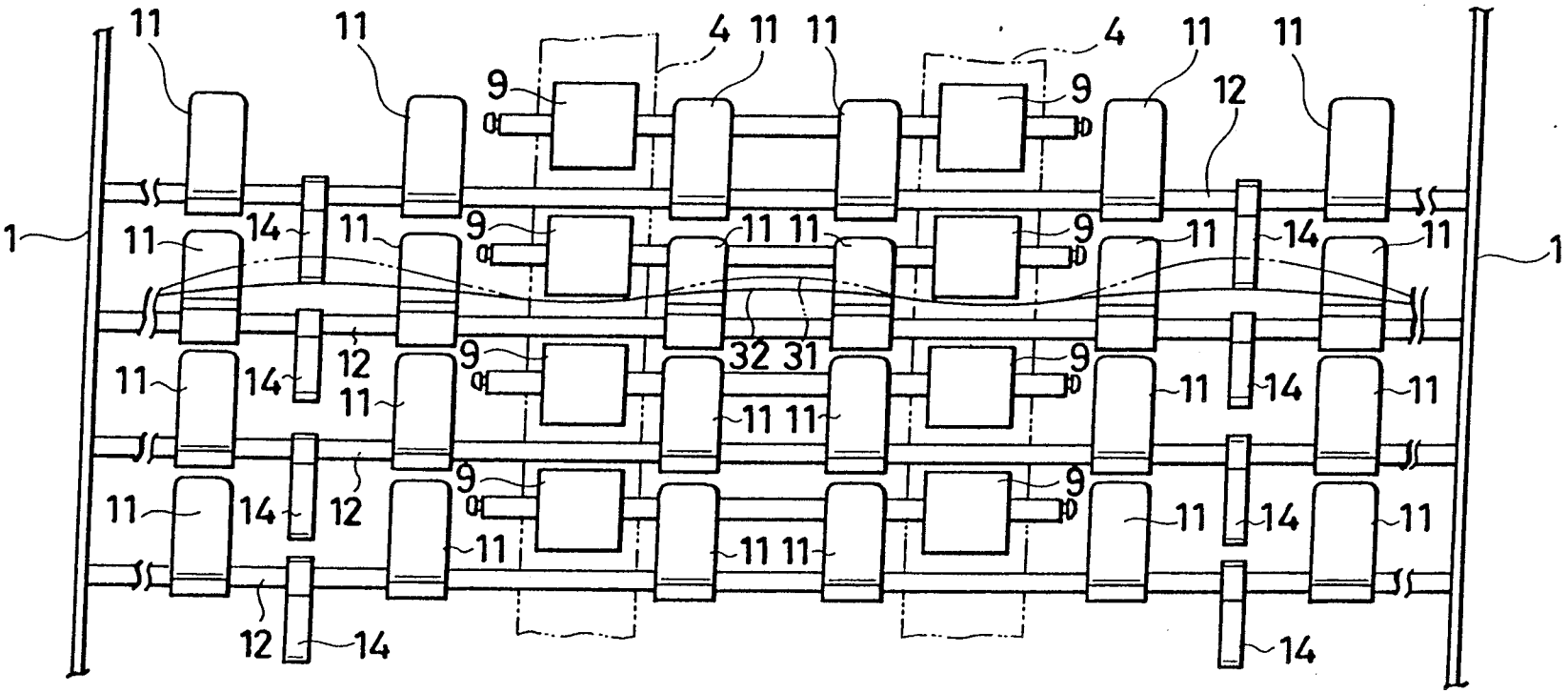
FIG. 3 is a front elevational view of the main portion.
Figure 4:
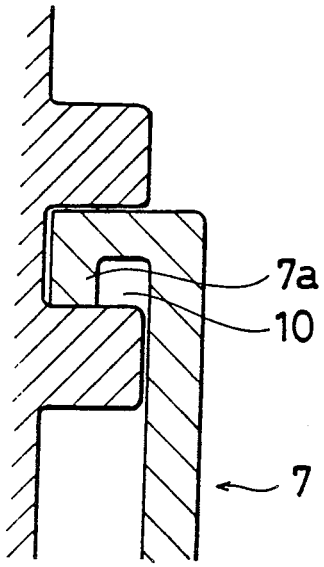
FIG. 4 is a sectional view taken along the line IV—IV in FIG. 2.
Figure 5:
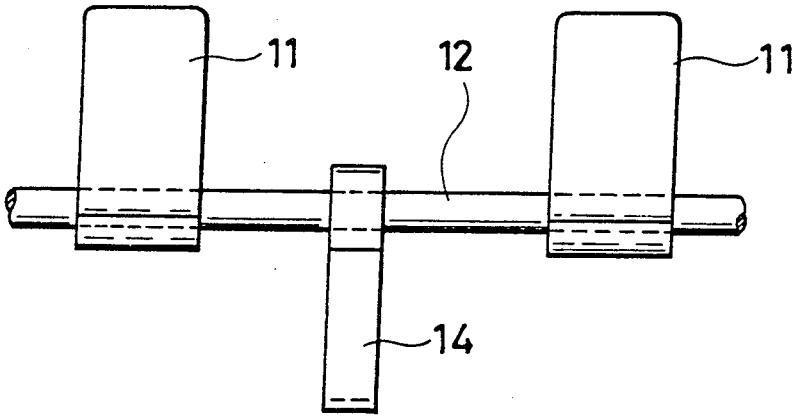
FIG. 5 is a front elevational view showing claw members and a restriction member of the sorter.

Referring now to FIG. 1, the sorter S includes a housing 1, two rollers 2, 3 arranged in a vertical direction in the housing 1. Two endless conveying belts 4 are passed over the two rollers 2, 3 as shown in FIG. 3. The conveying belt 4 is driven in a discharge direction or in a couterclockwise direction in FIG. 1 by rotation of the rollers 2, 3. A guide plate 5 is disposed near the upper roller 2. Also, a pair 6 of discharge rollers is disposed near the upper roller 2. The guide plate 5 is pivoted by a solenoid (not shown) to change from a first path in which a paper sheet is transferred from a discharge portion of the main body A (a right upper portion of FIG. 1) to the discharge roller pair 6 to a second path in which a paper sheet is transferred from the discharge portion of the main body A to the conveying belt 4 and vice versa.

Figure 2:
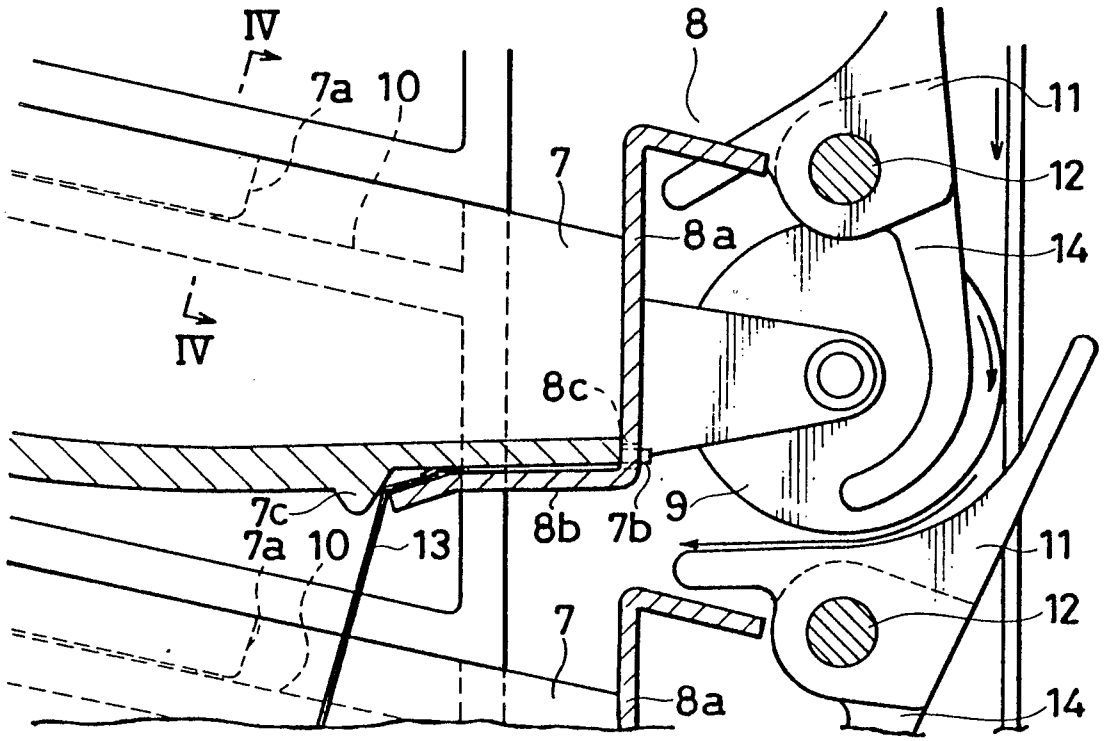
FIG. 2 is a sectional view of a main portion of the first sorter.

On a discharge side of the conveying belt 4 are vertically provided a plurality of support members 8 for supporting respective bins 7. The support member 8 is L-shaped in section as shown in FIG. 2. Specifically, the support member 8 has a vertical wall 8*a* for supporting tail edges of paper sheets placed in the bin 7, and a horizontal wall 8*b* for supporting a base end portion of the bin 7. A conveying roller 9 is rotatably attached to the vertical wall 8*a*. The conveying roller 9 is made in contact with the conveying belt 4.

The bin 7 has guide projections 7*a* in respective upper portions of the opposite side walls thereof, and a plurality of projections 7*b* in the base portion thereof or in a right end portion in FIG. 2. On the other hand, the housing 1 has guide grooves 10 for slidably supporting the guide projections 7*a* in the opposite side walls thereof. The vertical wall 8*a* of the support member 8 has holes 8*c* through which the projections 7*b* is to be inserted. The bin 7 is mounted in the sorter S by inserting the guide projections 7*a* in the respective guide grooves 10 from the outside (from left side in FIG. 1) and then the projections 7*b* through the holes 8*c*.

Referring to FIG. 3, a horizontal shaft 12 is provided under horizontally disposed two conveying rollers 9. The opposite ends of the horizontal shaft 12 are supported by the opposite side walls of the housing 1. Six claw members 11 (guide means) are pivotably attached to the horizontal shaft 12. Specifically, two claw members 11 are provided between the horizontally disposed two conveying rollers 9, another two claw members 11 are provided on the left side of the two conveying rollers 9, the remaining two claw members 11 are provided on the right side of the two conveying rollers 9. Each claw member 11 is pivoted by a solenoid (not shown). The claw member has such a form that when pivoted to a predetermined position in the clockwise direction in FIGS. 1 and 2, the claw member can guide a paper sheet from the conveying belts 4 to the bin 7.

A discharge brush 13 is attached to the support member 8 with a base portion of the discharge brush 13 being fixed on the upper surface of the horizontal wall 8*b*. The bin 7 is provided with a projection 7*c* extending in a widthwise direction on the underside thereof so that when the bin 7 is mounted on the support member 8, the discharge brush 13 is bent by the projection 7*c* to project in a paper transfer path.

Furthermore, restriction members 14 (restriction means) are provided between the claw members 11 on the respective sides of the horizontally disposed two conveying rollers 9. The restriction member 14 is pivotably attached to the horizontal shaft 12 in the same way as the claw member 11. Also, the restriction member 14 extends to nearly the same level as the lowermost portion of the conveying roller 9 attached to the next under horizontal shaft 12, and has such a form that when pivoted to a predetermined position in the counterclockwise direction in FIG. 2, the outer surface of the restriction member 14 comes in substantially agreement with a right lower surface of the conveying roller 9. Accordingly, a paper sheet in the process of being transferred to the bin 7 is kept from rising by the conveying rollers 9 and the restriction members 14, and consequently eliminated from being waved.

Next, operation of the sorter will be described. A paper sheet is supplied from the discharge portion of the main body A or from the right upper portion in FIG. 1, and transferred to the guide plate 5.

When the sorter is set in the non-sort state, the guide plate 5 is held in a position shown by imaginary lines in FIG. 1, and the paper sheet is transferred directly to an uppermost bin 7 through the discharge roller pair 6.

When the sorter is set in the sort state, the guide plate 5 is held in a position shown by solid lines in FIG. 1 and the conveying belts 4 are driven, so that the paper sheet is transferred downward by the conveying belts 4. The conveying rollers 9 in contact with the conveying belts 4 are driven by virtue of frictional force between the conveying rollers 9 and the conveying belts 4.

Among the claw members, only claw members 11 corresponding to a selected bin 7 are pivoted in the clockwise direction in FIG. 2, so that the paper sheet is transferred to the selected bin 7 along the pivoted claw members by the rotation of the conveying rollers 9 (see arrows in FIG. 2).

In this time, the paper sheet is kept from moving in a downward direction by the claw members 11, and also is kept from moving in an upward direction by the conveying rollers 9 and the restriction members 14 attached to the next upper horizontal shaft 12.

Accordingly, it could be seen that the sorter of the present invention, which carries the restriction members 14, can eliminate the wave of paper sheet which inevitably occurs in the conventional sorter (see an imaginary line 31 in FIG. 3), and can discharge the paper sheet in a flat state (see a solid line 32 in FIG. 3). Thus the jam is prevented which is caused due to the fact that a wavy paper sheet comes into contact with the support member 8.

Also, it is a fact that a sheet of paper has the following properties. A sheet of paper has two different directions in respect of flexibility, specifically, one direction in which a paper sheet is liable to bend, the other direction in which a paper sheet is unliable to bend. Also, a sheet of paper is liable to bend under high temperature and high pressure.

The sorter of the present invention which prevents a sheet of paper from waving by the restriction members 14 makes it possible to smoothly discharge paper sheets irrespective of the above-mentioned properties of paper.

Figure 7:
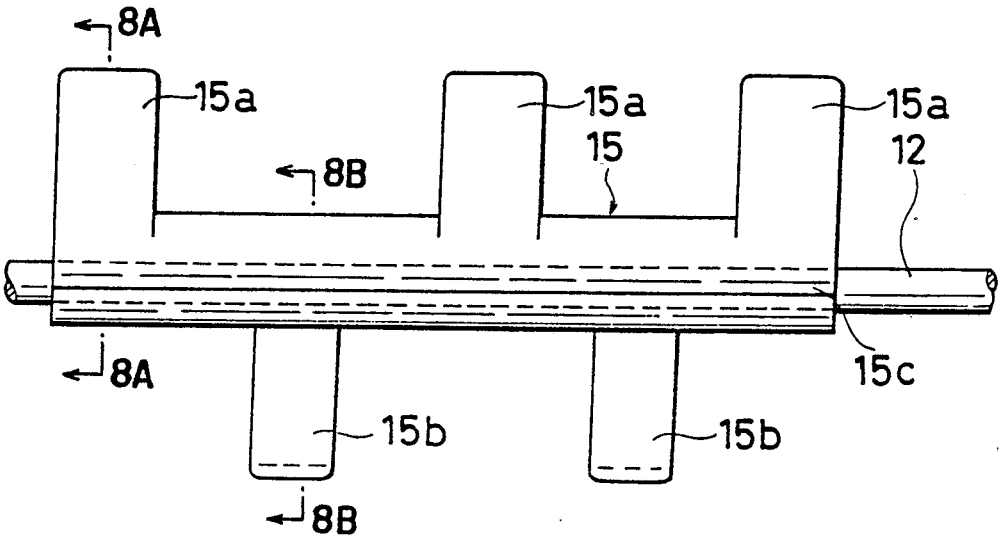
FIG. 7 is a front elevational view showing a pivotable member used in a sorter according to a second embodiment of the present invention.
Figure 8:
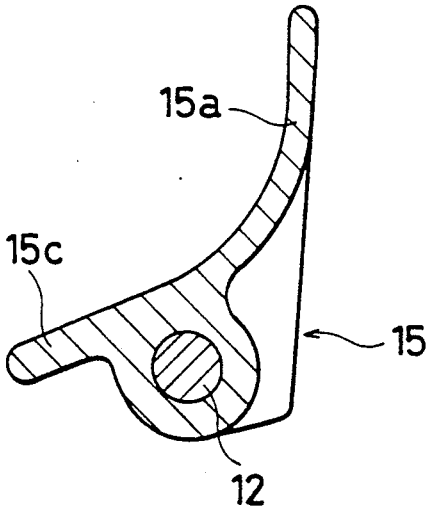
FIG. 8 (*a*) is a sectional view taken along the line 8A—8A in FIG. 7.
Figure 8:
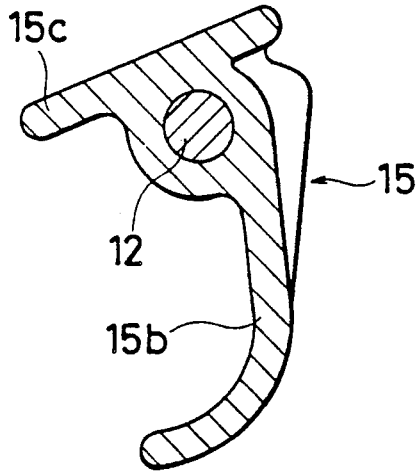
Figure 9:
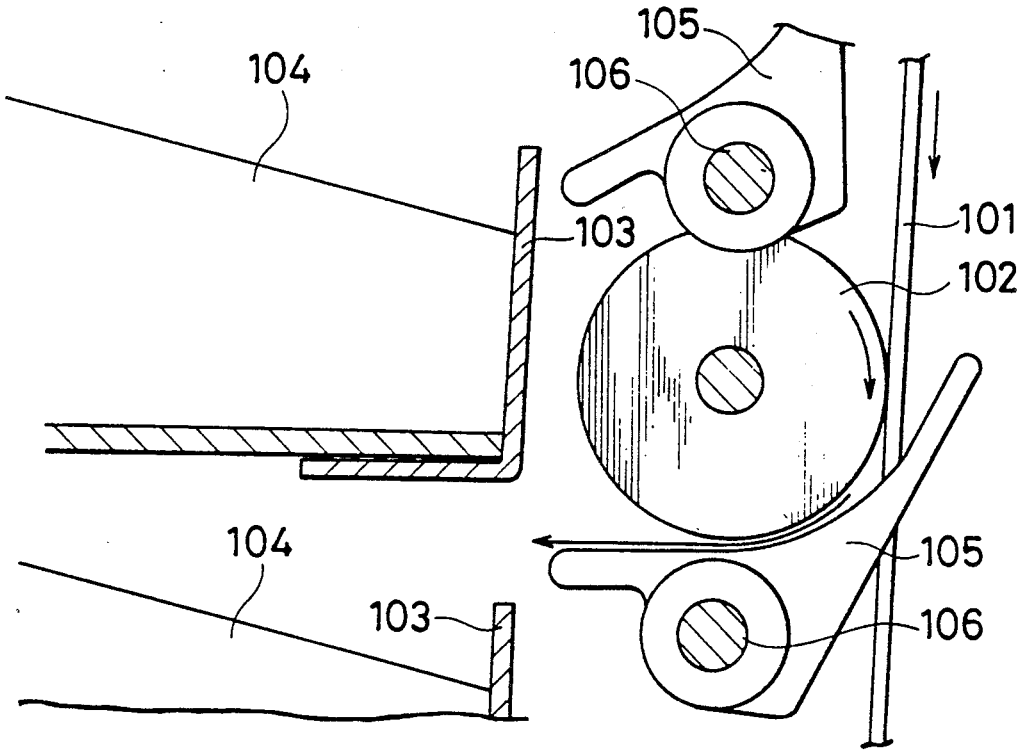
PRIOR ART FIG.9
FIG. 9 is a sectional view showing a main portion of a conventional sorter.
Figure 10:
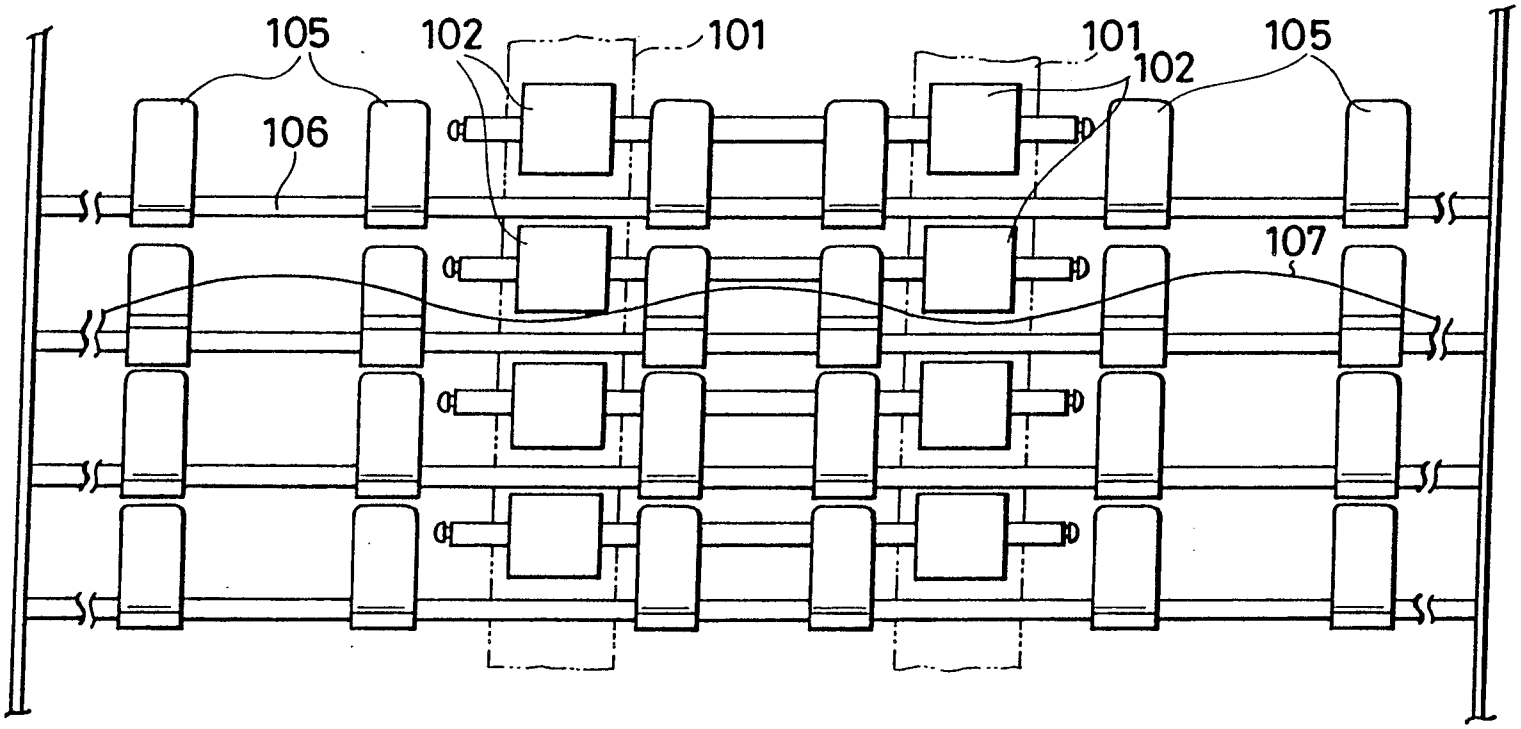
PRIOR ART FIG.10
FIG. 10 is a front elevational view of the main portion of a conventional sorter.

Next, a second embodiment of the present invention will be described with reference to FIGS. 7 and 8. In the first sorter, two claw members 11 and one restriction member 14 are provided on one of the both sides of the horizontally disposed two conveying rollers 9. In the second embodiment, a single pivotable member 15 is provided for performing the functions of the two claw members 11 and the one restriction member 14. The pivotable member 15 is formed into one body, and has three claw portions 15*a* and two restriction portions 15*b* and a projection 15*c* on a discharge side thereof. The projection 15*c* is extended between the opposite ends of the pivotable member 15 in parallel with a shaft 12.

The pivotable member 15 integrally formed with the claw portions 15*a* and the restriction portions 15*b* prevents a sheet of paper from waving, and assures smooth discharging of the paper sheet. The projection 15*c* constituting a part of guide means is extended between the opposite ends of the pivotable member 15, so that a paper sheet is positively prevented from bending downward.

It should be noted that the form of guide means and restriction means of the present invention, and the number of guide means and restriction means are not limited in the above-mentioned embodiments. Also, it should be noted that the attachment position of restriction means is not limited in the above-mentioned embodiments. It is sufficient to attach restriction means to such a position that the restriction means comes in substantially agreement with conveying means. In the first embodiment, for example, a restriction member 14 may be attached to an intermediate portion of a horizontal shaft 12. Also, it is not necessary to attach a restriction member 14 to a shaft 12 to which a claw member 11 is attached. A restriction member 14 may be attached to a separate shaft. Further, restriction means is not necessary to be pivoted.

Moreover, although the sorters of the above-mentioned embodiments transfer sheets of paper from an upper portion to bins by use of conveying belts, it should be noted that the present invention is applicable for sorters in which sheets of paper are transferred from a lower portion to an upper portion. In a sorter in which sheets of paper are transferred upward, guide means is arranged above conveying means, and restriction means is arranged in such a position as to face the underside of a paper sheet in the same way as conveying means.

What is claimed is:

1. A sorter for sorting sheets comprising:

a plurality of juxtaposed sheet-receiving means;

conveying means for conveying successive sheets;

a plurality of successive sheet delivery means disposed between each of said sheet-receiving means and said conveying means for selectively delivering a sheet to a respective sheet-receiving means;

said sheet delivery means comprising a guide means moveable from a non-delivery position to a delivery position, said guide means delivering a sheet to a respective sheet-receiving means along a delivery path when in said delivery position while allowing said sheets to by-pass the respective sheet delivery means when in said non-delivery position;

said sheet delivery means further comprising restriction means extending to a restricting position juxtaposed to the delivery path of a sheet being delivered by the next successive sheet delivery means to prevent the last said sheet from waving as the last said sheet is being delivered by said next successive sheet delivery means to the respective sheet receiving means.

2. A sorter according to claim 1, wherein said sheet delivery means comprises a conveyor member operable to deliver said sheet to its respective sheet receiving means.

3. A sorter according to claim 2, wherein said conveyor member comprises a least one conveyor roller rotatable about an axis generally perpendicular to said delivery path, said guide members being axially spaced from said conveyor roller.

4. A sorter according to claim 3, wherein said restriction means are axially spaced from said conveyor roller.

5. A sorter according to claim 3, wherein said restriction means are axially spaced from said guide member.

6. A sorter according to claim 1, wherein the guide means of one sheet delivery means and the restriction means of the next successive sheet delivery means are unitarily formed as a single integral body.

7. A sorter according to claim 6, wherein said guide means comprises a shaft on which said body is mounted.

8. A sorter according to claim 1, wherein said sheet delivery means comprises a shaft on which said guide members are disposed, said restriction means for one sheet delivery means being mounted on said shaft of the preceding sheet delivery means.

9. A sorter according to claim 1, wherein said sheet delivery means comprises a conveyor roller, said restriction means comprising a finger-like projection which extends to a position substantially aligned with a peripheral portion of the conveyor roller of the next succeeding sheet delivery means.

10. A sorter according to claim 1, wherein said conveying means conveys said sheets along a conveying path, said sheet delivery means comprising a conveyor roller, said conveyor roller having one portion disposed substantially tangentially to said conveying path, said delivery path extending generally transversely to said conveying path, said conveyor roller having another portion circumferentially spaced from said one portion and disposed substantially tangentially to said delivery path, the restriction means of said sheet delivery means extending to a position juxtaposed to said other portion of said conveyor roller of the next succeeding sheet delivery means such that said restriction means prevents waving of the sheet being delivered along the delivery path of said next succeeding sheet delivery means.

* * * * *